US010403301B2

(12) United States Patent
Faller et al.

(10) Patent No.: US 10,403,301 B2
(45) Date of Patent: Sep. 3, 2019

(54) AUDIO SIGNAL PROCESSING APPARATUS FOR PROCESSING AN INPUT EARPIECE AUDIO SIGNAL UPON THE BASIS OF A MICROPHONE AUDIO SIGNAL

(71) Applicant: HUAWEI TECHNOLOGIES CO., LTD., Shenzhen, Guangdong (CN)

(72) Inventors: Christof Faller, Uster (CH); Alexis Favrot, Uster (CH); Peter Grosche, Munich (DE); Yue Lang, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 53 days.

(21) Appl. No.: 15/789,131

(22) Filed: Oct. 20, 2017

(65) Prior Publication Data

US 2018/0040335 A1 Feb. 8, 2018

Related U.S. Application Data

(63) Continuation of application No. PCT/EP2015/058809, filed on Apr. 23, 2015.

(51) Int. Cl.

| | |
|---|---|
| ***G10L 25/84*** | (2013.01) |
| ***G10L 21/034*** | (2013.01) |
| ***G10L 21/02*** | (2013.01) |
| *G10L 25/78* | (2013.01) |

(52) U.S. Cl.

CPC ..... *G10L 21/034* (2013.01); *G10L 21/0205* (2013.01); *G10L 25/84* (2013.01); *G10L 25/78* (2013.01)

(58) Field of Classification Search

CPC ..... G10L 25/84
USPC ..... 704/225
See application file for complete search history.

(56) References Cited

U.S. PATENT DOCUMENTS

| | | | | |
|---|---|---|---|---|
| 9,860,656 | B2 * | 1/2018 | Jensen | H04R 25/407 |
| 2010/0017205 | A1 | 1/2010 | Visser et al. | |
| 2011/0125492 | A1 | 5/2011 | Alves et al. | |
| 2012/0263317 | A1 | 10/2012 | Shin et al. | |
| 2013/0024193 | A1 | 1/2013 | Yeldener et al. | |

OTHER PUBLICATIONS

F. Felber, *An Automatic Volume Control for Preserving Intelligibility*, 34th IEEE Sarnoff Symposium, Princeton, NJ, May 3-4, 2011 (5 pp.).

(Continued)

*Primary Examiner* — Susan I McFadden
(74) *Attorney, Agent, or Firm* — Conley Rose, P.C.

(57) ABSTRACT

The invention relates to an audio signal processing apparatus for processing an input earpiece audio signal upon the basis of a microphone audio signal, the audio signal processing apparatus comprising a voice activity detector being configured to determine a voice activity indicator signal upon the basis of the input earpiece audio signal, a noise magnitude determiner being configured to determine a microphone noise magnitude indicator signal upon the basis of the microphone audio signal, a gain factor determiner being configured to determine a gain factor signal upon the basis of the voice activity indicator signal and the microphone noise magnitude indicator signal, and a weighter being configured to weight the input earpiece audio signal by the gain factor signal to obtain an output earpiece audio signal.

15 Claims, 2 Drawing Sheets

(56) References Cited

OTHER PUBLICATIONS

B. Sauert et al., *Real-Time Near-End Listening Enhancement for Mobile Phones*, Institute of Communication Systems and Data Processing, RWTH Aachen University, Germany (3 pp.).
M. Tzur Zibulski et al., *Sound Equalization in a Noisy Environment*, Audio Engineering Society Convention Paper 5364, May 12-15, 2001, Amsterdam, The Netherlands, pp. 1-4.
Eberhard Hänsler, *Acoustic Echo and Noise Control: Where Dowe Come From—Where Do We Go*?, Darmstadt University of Technology, Darmstadt, Germany (4 pp.).
R. Martin, *Noise Power Spectral Density Estimation Based on Optimal Smoothing and Minimum Statistics*, IEEE Transactions on Speech and Audio Processing, vol. 9, No. 5, Jul. 2001, pp. 504-512.
International Search Report, dated Feb. 3, 2016, in International Application No. PCT/EP2015/058809 (5 pp.).
Written Opinion of the International Searching Authority, dated Feb. 3, 2016, in International Application No. PCT/EP2015/058809 (5 pp.).
International Search Report dated Feb. 3, 2016 in corresponding International Patent Application No. PCT/EP2015/058809.

* cited by examiner

AUDIO SIGNAL PROCESSING APPARATUS FOR PROCESSING AN INPUT EARPIECE AUDIO SIGNAL UPON THE BASIS OF A MICROPHONE AUDIO SIGNAL

CROSS-REFERENCE TO RELATED APPLICATIONS

This application is a continuation of International Application No. PCT/EP2015/058809, filed on Apr. 23, 2015, the disclosure of which is hereby incorporated by reference in its entirety.

TECHNICAL FIELD

The invention relates to the field of audio signal processing, in particular to earpiece audio signal enhancement in mobile communication devices.

BACKGROUND

Mobile communication devices can be used for communications while being exposed to different environmental conditions. The environmental conditions can largely influence the quality of communications, wherein two types of noise sources are typically considered. At the far-end side, noise is captured by the far-end microphone together with the desired voice component and is transmitted to the near-end side. At the near-end side, voice intelligibility may be affected by near-end noise, i.e. nearby noise sources masking the earpiece audio signal.

Enhancing the quality of a conversation, which is disturbed by noise, is conventionally addressed at the far-end side by the use of different audio signal processing techniques, such as noise cancellation, noise suppression, or beam-forming. A drawback of these techniques is, however, that the enhancements are only applied to the microphone signal at the fear-end side, which is then transmitted to the near-end side where the participant gets all the benefits. At the other side, no enhancements may be noticed.

Furthermore, adaptive gain or equalization control techniques can be applied on the near-end side. These techniques enable an adaptive gain or equalization control of the earpiece audio signal as a function of local background noise magnitude and earpiece audio signal statistics, wherein the loudness of the earpiece audio signal is adjusted in a frequency-dependent manner such that it is not masked by the local background noise. However, assumptions on human perception and voice intelligibility are applied in order to compare spectral components of both the earpiece audio signal and the local background noise, which makes these techniques complex and slow while adapting to changing noise magnitudes. In addition, complex voice activity detection (VAD) on the microphone audio signal is used in order to estimate the background noise magnitude only when the near-end participant is silent.

In F. Felber, "An automatic volume control for preserving intelligibility", 34th IEEE Sarnoff Symposium, 2011, an adaptive gain technique for earpiece audio signals is described.

In A. Goldin, M. Tzur Zibulski, "Sound equalization in a noisy environment", Audio Engineering Society Convention 110, 2001, an equalization control technique for earpiece audio signals is described.

In B. Sauert, F. Heese, P. Vary, "Real-time near-end listening enhancement for mobile phones", IEEE International Conference on Acoustics, Speech, and Signal Processing, 2014, a further equalization control technique for earpiece audio signals is described.

SUMMARY

It is an object of the invention to provide an efficient concept for processing an input earpiece audio signal upon the basis of a microphone audio signal.

This object is achieved by the features of the independent claims. Further implementation forms are apparent from the dependent claims, the description and the figures.

The invention is based on the finding that a voice activity detection (VAD) can be performed on an earpiece audio signal in order to detect when the far-end side participant speaks, and to determine a noise estimate at the near-end side upon the basis of a microphone audio signal when the far-end side participant speaks. When the far-end side participant speaks, the near-end side participant is typically silent, since simultaneous talk is usually rare. Thereby, an adaptive enhancement of the earpiece audio signal at the near-end side is achieved.

According to a first aspect, the invention relates to an audio signal processing apparatus for processing an input earpiece audio signal upon the basis of a microphone audio signal, the input earpiece audio signal being associated with the microphone audio signal, the audio signal processing apparatus comprising a voice activity detector being configured to determine a voice activity indicator signal upon the basis of the input earpiece audio signal, wherein the voice activity indicator signal indicates a magnitude of a voice component within the input earpiece audio signal, a noise magnitude determiner being configured to determine a microphone noise magnitude indicator signal upon the basis of the microphone audio signal, wherein the microphone noise magnitude indicator signal indicates a magnitude of a noise component within the microphone audio signal, a gain factor determiner being configured to determine a gain factor signal upon the basis of the voice activity indicator signal and the microphone noise magnitude indicator signal, wherein the gain factor signal indicates a gain associated with the input earpiece audio signal, and a weighter being configured to weight the input earpiece audio signal by the gain factor signal to obtain an output earpiece audio signal. Thus, an efficient concept for processing the input earpiece audio signal upon the basis of the microphone audio signal is realized.

The audio signal processing apparatus allows for an efficient adaption of a magnitude of the input earpiece audio signal upon the basis of the microphone audio signal, and for an efficient mitigation of near-end side noise effects. The magnitudes can equivalently be referred to as levels. The weighting can comprise a multiplication.

In a first implementation form of the audio signal processing apparatus according to the first aspect as such, the voice activity detector is further configured to determine an earpiece noise magnitude indicator signal upon the basis of the input earpiece audio signal, wherein the earpiece noise magnitude indicator signal indicates a magnitude of a noise component within the input earpiece audio signal, and wherein the voice activity detector is further configured to determine the voice activity indicator signal upon the basis of the earpiece noise magnitude indicator signal. Thus, the voice activity indicator signal is determined robustly and efficiently.

A minimum statistics approach and a two-side temporal smoothing with regard to the input earpiece audio signal can be applied. The minimum statistics can be evaluated over a time window having a predetermined duration. The two-side temporal smoothing can be realized using a recursive infinite impulse response (IIR) low-pass filter.

In a second implementation form of the audio signal processing apparatus according to the first aspect as such or any preceding implementation form of the first aspect, the voice activity detector is further configured to determine a first envelope indicator signal and a second envelope indicator signal, wherein the first envelope indicator signal indicates a magnitude of a first envelope of the input earpiece audio signal, wherein the second envelope indicator signal indicates a magnitude of a second envelope of the input earpiece audio signal, and wherein the voice activity detector is further configured to determine the voice activity indicator signal upon the basis of the first envelope indicator signal and the second envelope indicator signal. Thus, the voice activity indicator signal is determined robustly and efficiently.

A two-side temporal smoothing with regard to the input earpiece audio signal can be applied. The two-side temporal smoothing can be realized using a recursive infinite impulse response (IIR) low-pass filter.

The first envelope indicator signal can relate to a slow envelope of the input earpiece audio signal. The second envelope indicator signal can relate to a fast envelope of the input earpiece audio signal.

In a third implementation form of the audio signal processing apparatus according to the first aspect as such or any preceding implementation form of the first aspect, the voice activity detector is further configured to limit the voice activity indicator signal with regard to a predetermined voice activity indicator limiting range. Thus, the voice activity indicator signal is provided robustly.

The predetermined voice activity indicator limiting range can e.g. be the range [0; 1]. The limitation of the voice activity indicator signal can comprise a normalization of the voice activity indicator signal.

In a fourth implementation form of the audio signal processing apparatus according to the first aspect as such or any preceding implementation form of the first aspect, the voice activity detector is further configured to filter the voice activity indicator signal in time upon the basis of a predetermined smoothing filtering function. Thus, quickly fluctuating values of the voice activity indicator signal are mitigated efficiently.

The predetermined smoothing filtering function can be a low-pass filtering function.

In a fifth implementation form of the audio signal processing apparatus according to the first aspect as such or any preceding implementation form of the first aspect, the noise magnitude determiner is further configured to determine the microphone noise magnitude indicator signal upon the basis of the voice activity indicator signal. Thus, the microphone noise magnitude indicator signal is determined robustly and efficiently.

A high voice component within the input earpiece audio signal can correspond to a low voice component within the microphone audio signal.

A one-side temporal smoothing using a recursive infinite impulse response (IIR) low-pass filter can be applied. The voice activity indicator signal can be used as a time-dependent filter coefficient.

In a sixth implementation form of the audio signal processing apparatus according to the first aspect as such or any preceding implementation form of the first aspect, the gain factor determiner is further configured to compare the microphone noise magnitude indicator signal with a predetermined noise magnitude threshold, wherein the gain factor determiner is further configured to determine the gain factor signal if the microphone noise magnitude indicator signal is greater than the predetermined noise magnitude threshold. Thus, the input earpiece audio signal is weighted if the microphone noise magnitude indicator signal exceeds the predetermined noise magnitude threshold.

The predetermined noise magnitude threshold can relate to a threshold of annoyance with regard to near-end noise.

In a seventh implementation form of the audio signal processing apparatus according to the first aspect as such or any preceding implementation form of the first aspect, the gain factor determiner is further configured to compare the voice activity indicator signal with a predetermined voice activity threshold, and wherein the gain factor determiner is further configured to determine the gain factor signal if the voice activity indicator signal is greater than the predetermined voice activity threshold. Thus, the input earpiece audio signal is weighted if the voice activity indicator signal exceeds the predetermined voice activity threshold.

The predetermined voice activity threshold can relate to a threshold of presence of a voice component within the input earpiece audio signal.

In an eighth implementation form of the audio signal processing apparatus according to the first aspect as such or any preceding implementation form of the first aspect, the gain factor determiner is further configured to determine the gain factor signal according to the following equation:

$$\Delta_G(n) = x_{vad}(n)\frac{w_y(n)}{\eta_{w_y}},$$

wherein $\Delta_G$ denotes the gain factor signal, $w_y$ denotes the microphone noise magnitude indicator signal, $\eta_{w_y}$ denotes a predetermined noise magnitude threshold, $x_{vad}$ denotes the voice activity indicator signal, and n denotes a sample index. Thus, the gain factor signal is determined efficiently.

In a ninth implementation form of the audio signal processing apparatus according to the first aspect as such or any preceding implementation form of the first aspect, the gain factor determiner is further configured to limit the gain factor signal with regard to a predetermined gain factor limiting range. Thus, the gain factor signal is provided efficiently.

The predetermined gain factor limiting range can e.g. be the range [1; $\Delta_{G0}$], wherein $\Delta_{G0}$ denotes a predetermined maximum value of the gain factor signal. The limitation of the gain factor signal can comprise a normalization of the gain factor signal.

In a tenth implementation form of the audio signal processing apparatus according to the first aspect as such or any preceding implementation form of the first aspect, the gain factor determiner is further configured to filter the gain factor signal in time upon the basis of a further predetermined smoothing filtering function. Thus, quickly fluctuating values of the gain factor signal are mitigated efficiently.

The further predetermined smoothing filtering function can be a further low-pass filtering function.

In an eleventh implementation form of the audio signal processing apparatus according to the first aspect as such or any preceding implementation form of the first aspect, the weighter is further configured to weight the input earpiece audio signal by a predetermined user gain factor. Thus, a gain factor determined by a user is applied efficiently.

In a twelfth implementation form of the audio signal processing apparatus according to the first aspect as such or any preceding implementation form of the first aspect, the audio signal processing apparatus further comprises a communication interface being configured to receive the input earpiece audio signal over a communication network, and to transmit the microphone audio signal over the communication network. Thus, a communication device for communicating over the communication network is formed by the audio signal processing apparatus.

The audio signal processing apparatus can further comprise an earpiece being configured to emit the output earpiece audio signal. The audio signal processing apparatus can further comprise a microphone being configured to provide the microphone audio signal.

According to a second aspect, the invention relates to an audio signal processing method for processing an input earpiece audio signal upon the basis of a microphone audio signal, the input earpiece audio signal being associated with the microphone audio signal, the audio signal processing method comprising determining, by a voice activity detector, a voice activity indicator signal upon the basis of the input earpiece audio signal, wherein the voice activity indicator signal indicates a magnitude of a voice component within the input earpiece audio signal, determining, by a noise magnitude determiner, a microphone noise magnitude indicator signal upon the basis of the microphone audio signal, wherein the microphone noise magnitude indicator signal indicates a magnitude of a noise component within the microphone audio signal, determining, by a gain factor determiner, a gain factor signal upon the basis of the voice activity indicator signal and the microphone noise magnitude indicator signal, wherein the gain factor signal indicates a gain associated with the input earpiece audio signal, and weighting, by a weighter, the input earpiece audio signal by the gain factor signal to obtain an output earpiece audio signal. Thus, an efficient concept for processing the input earpiece audio signal upon the basis of the microphone audio signal is realized.

The audio signal processing method can be performed by the audio signal processing apparatus. Further features of the audio signal processing method directly result from the functionality of the audio signal processing apparatus.

In a first implementation form of the audio signal processing method according to the second aspect as such, the method further comprises determining, by the voice activity detector, an earpiece noise magnitude indicator signal upon the basis of the input earpiece audio signal, wherein the earpiece noise magnitude indicator signal indicates a magnitude of a noise component within the input earpiece audio signal, and determining, by the voice activity detector, the voice activity indicator signal upon the basis of the earpiece noise magnitude indicator signal. Thus, the vice activity indicator signal is determined efficiently.

In a second implementation form of the audio signal processing method according to the second aspect as such or any preceding implementation form of the second aspect, the method further comprises determining, by the voice activity detector, a first envelope indicator signal and a second envelope indicator signal, wherein the first envelope indicator signal indicates a magnitude of a first envelope of the input earpiece audio signal, wherein the second envelope indicator signal indicates a magnitude of a second envelope of the input earpiece audio signal, and determining, by the voice activity detector, the voice activity indicator signal upon the basis of the first envelope indicator signal and the second envelope indicator signal. Thus, the voice activity indicator signal is determined efficiently.

In a third implementation form of the audio signal processing method according to the second aspect as such or any preceding implementation form of the second aspect, the method further comprises limiting, by the voice activity detector, the voice activity indicator signal with regard to a predetermined voice activity indicator limiting range. Thus, the voice activity indicator signal is provided efficiently.

In a fourth implementation form of the audio signal processing method according to the second aspect as such or any preceding implementation form of the second aspect, the method further comprises filtering, by the voice activity detector, the voice activity indicator signal in time upon the basis of a predetermined smoothing filtering function. Thus, quickly fluctuating values of the voice activity indicator signal are mitigated efficiently.

In a fifth implementation form of the audio signal processing method according to the second aspect as such or any preceding implementation form of the second aspect, the method further comprises determining, by the noise magnitude determiner, the microphone noise magnitude indicator signal upon the basis of the voice activity indicator signal. Thus, the microphone noise magnitude indicator signal is determined efficiently.

In a sixth implementation form of the audio signal processing method according to the second aspect as such or any preceding implementation form of the second aspect, the method further comprises comparing, by the gain factor determiner, the microphone noise magnitude indicator signal with a predetermined noise magnitude threshold, and determining, by the gain factor determiner, the gain factor signal if the microphone noise magnitude indicator signal is greater than the predetermined noise magnitude threshold. Thus, the input earpiece audio signal is weighted if the microphone noise magnitude indicator signal exceeds the predetermined noise magnitude threshold.

In a seventh implementation form of the audio signal processing method according to the second aspect as such or any preceding implementation form of the second aspect, the method further comprises comparing, by the gain factor determiner, the voice activity indicator signal with a predetermined voice activity threshold, and determining, by the gain factor determiner, the gain factor signal if the voice activity indicator signal is greater than the predetermined voice activity threshold. Thus, the input earpiece audio signal is weighted if the voice activity indicator signal exceeds the predetermined voice activity threshold.

In an eighth implementation form of the audio signal processing method according to the second aspect as such or any preceding implementation form of the second aspect, the method further comprises determining, by the gain factor determiner, the gain factor signal according to the following equation:

$$\Delta_G(n) = x_{vad}(n)\frac{w_y(n)}{\eta_{w_y}},$$

wherein $\Delta_G$ denotes the gain factor signal, $w_y$ denotes the microphone noise magnitude indicator signal, $\eta_{w_y}$ denotes a predetermined noise magnitude threshold, $x_{vad}$ denotes the voice activity indicator signal, and n denotes a sample index. Thus, the gain factor signal is determined efficiently.

In a ninth implementation form of the audio signal processing method according to the second aspect as such or any preceding implementation form of the second aspect, the method further comprises limiting, by the gain factor determiner, the gain factor signal with regard to a predetermined gain factor limiting range. Thus, the gain factor signal is provided efficiently.

In a tenth implementation form of the audio signal processing method according to the second aspect as such or any preceding implementation form of the second aspect, the method further comprises filtering, by the gain factor determiner, the gain factor signal in time upon the basis of a further predetermined smoothing filtering function. Thus, quickly fluctuating values of the gain factor signal are mitigated efficiently.

In an eleventh implementation form of the audio signal processing method according to the second aspect as such or any preceding implementation form of the second aspect, the method further comprises weighting, by the weighter, the input earpiece audio signal by a predetermined user gain factor. Thus, a gain factor determined by a user is applied efficiently.

In a twelfth implementation form of the audio signal processing method according to the second aspect as such or any preceding implementation form of the second aspect, the method further comprises receiving, by a communication interface, the input earpiece audio signal over a communication network, and transmitting, by the communication interface, the microphone audio signal over the communication network. Thus, communication over the communication network is performed by the audio signal processing method.

According to a third aspect, the invention relates to a computer program comprising a program code for performing the method when executed on a computer. Thus, the audio signal processing method is performed in an automatic and repeatable manner.

The audio signal processing apparatus can be programmably arranged to perform the computer program.

The invention can be implemented in hardware and/or software.

BRIEF DESCRIPTION OF EMBODIMENTS

Embodiments of the invention will be described with respect to the following figures, in which.

DETAILED DESCRIPTION OF EMBODIMENTS

Figure 1:
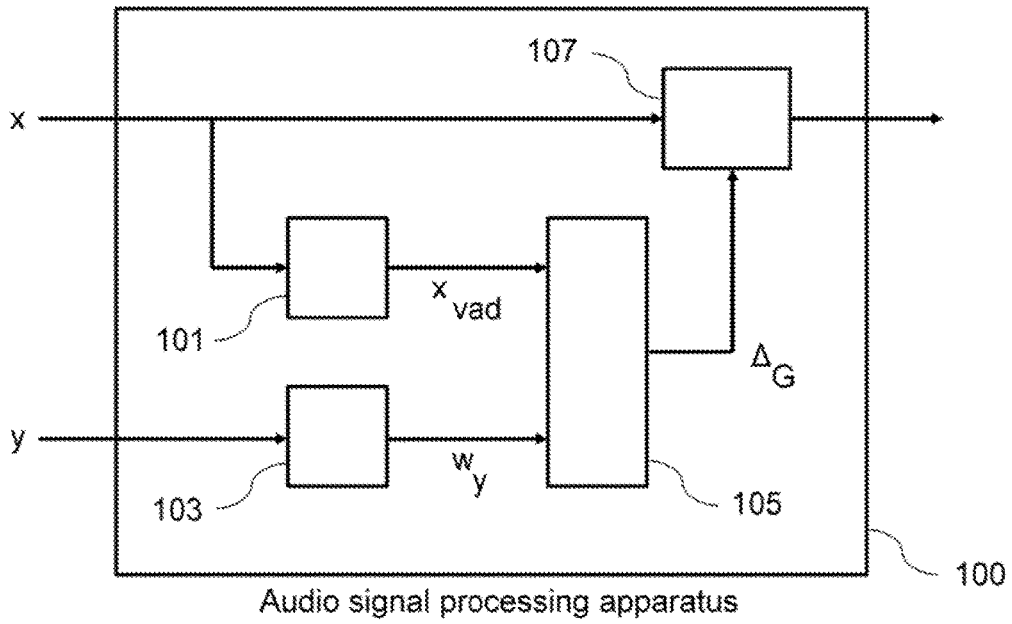
FIG. 1 shows a diagram of an audio signal processing apparatus for processing an input earpiece audio signal upon the basis of a microphone audio signal according to an embodiment.

FIG. 1 shows a diagram of an audio signal processing apparatus 100 for processing an input earpiece audio signal x upon the basis of a microphone audio signal y according to an embodiment. The input earpiece audio signal x is associated with the microphone audio signal y.

The audio signal processing apparatus 100 comprises a voice activity detector 101 being configured to determine a voice activity indicator signal $x_{vad}$ upon the basis of the input earpiece audio signal x, wherein the voice activity indicator signal $x_{vad}$ indicates a magnitude of a voice component within the input earpiece audio signal x, a noise magnitude determiner 103 being configured to determine a microphone noise magnitude indicator signal $w_y$ upon the basis of the microphone audio signal y, wherein the microphone noise magnitude indicator signal $w_y$ indicates a magnitude of a noise component within the microphone audio signal y, a gain factor determiner 105 being configured to determine a gain factor signal $\Delta_G$ upon the basis of the voice activity indicator signal $x_{vad}$ and the microphone noise magnitude indicator signal $w_y$, wherein the gain factor signal $\Delta_G$ indicates a gain associated with the input earpiece audio signal x, and a weighter 107 being configured to weight the input earpiece audio signal x by the gain factor signal $\Delta_G$ to obtain an output earpiece audio signal.

Figure 2:
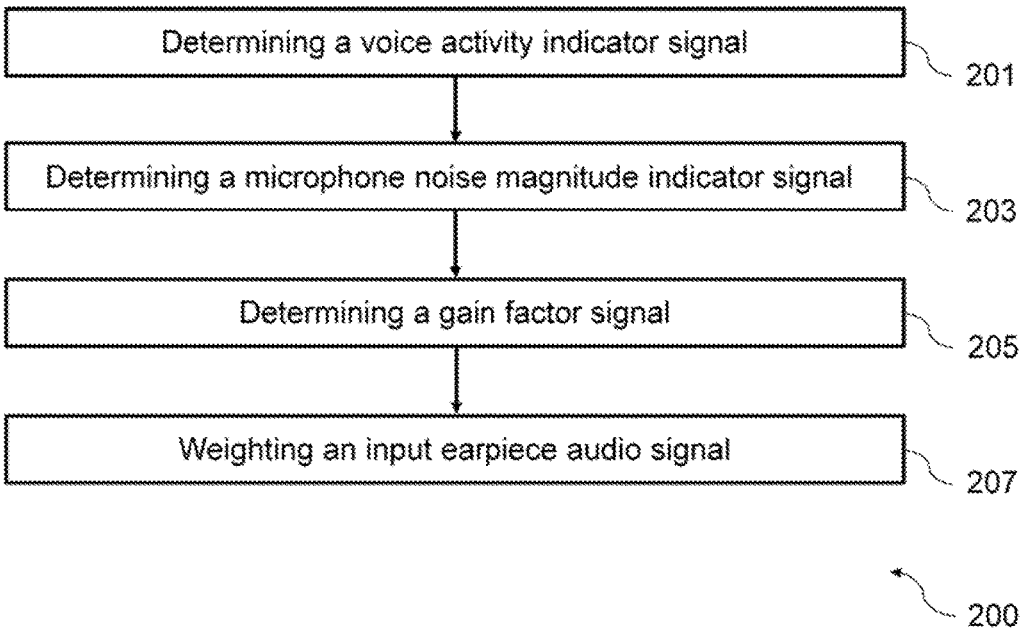
FIG. 2 shows a diagram of an audio signal processing method for processing an input earpiece audio signal upon the basis of a microphone audio signal according to an embodiment.

FIG. 2 shows a diagram of an audio signal processing method 200 for processing an input earpiece audio signal x upon the basis of a microphone audio signal y according to an embodiment. The input earpiece audio signal x is associated with the microphone audio signal y.

The audio signal processing method 200 comprises determining 201 a voice activity indicator signal $x_{vad}$ upon the basis of the input earpiece audio signal x, wherein the voice activity indicator signal $x_{vad}$ indicates a magnitude of a voice component within the input earpiece audio signal x, determining 203 a microphone noise magnitude indicator signal $w_y$ upon the basis of the microphone audio signal y, wherein the microphone noise magnitude indicator signal $w_y$ indicates a magnitude of a noise component within the microphone audio signal y, determining 205 a gain factor signal $\Delta_G$ upon the basis of the voice activity indicator signal $x_{vad}$ and the microphone noise magnitude indicator signal $w_y$, wherein the gain factor signal $\Delta_G$ indicates a gain associated with the input earpiece audio signal x, and weighting 207 the input earpiece audio signal x by the gain factor signal $\Delta_G$ to obtain an output earpiece audio signal.

In the following, further implementation forms and embodiments of the audio signal processing apparatus 100 and the audio signal processing method 200 are described.

The audio signal processing apparatus 100 and the audio signal processing method 200 can be applied for adaptive enhancement of an earpiece audio signal. The audio signal processing apparatus 100 and the audio signal processing method 200 can particularly be used for adaptive gain enhancement of an earpiece audio signal adapting to environmental noise recorded by a built-in microphone. Embodiments of the invention are used within mobile communication devices for telecommunication.

Local background noise during a conversation using communication devices may become so loud that a participant may not intelligibly understand the earpiece audio signal, while the talking participant on the other side is not disturbed.

The microphone audio signal may have a high signal-to-noise ratio (SNR) due to the proximity of the microphone 309 to the mouth, and quite often, the limitation in term of intelligibility comes more from the earpiece audio signal than the microphone audio signal y itself. When near-end side background noise magnitude is high, it can be hard to keep the earpiece audio signal intelligible. In quite environments, it may be reasonable to reduce the magnitude of the earpiece audio signal. The audio signal processing may help to enhance the earpiece audio signal for more clarity and may adapt the magnitude of the earpiece audio signal to changing environmental noise magnitudes.

As a result, in environments with varying background noise magnitudes, e.g. urban or street noise, the participant may have to constantly adapt the magnitude of the earpiece audio signal in order to ensure comfortable listening conditions and a high degree of voice intelligibility. An effort may consequently be devoted to increasing the listening comfort of the local participant by modifying the received earpiece audio signal, whereas the microphone audio signal y may not be additionally processed. The earpiece audio signal can dynamically adapt to the conversation e.g. based on the questions of how annoying the local background noise is, and whether the earpiece audio signal is transmitting useful information to the local participant.

Embodiments of the invention use a low complexity way of amplifying an input earpiece audio signal x, when environmental noise disturbs the communication. The input earpiece audio signal x may only be amplified when the environmental noise disturbs the communication. The amplification is realized by weighting the input earpiece audio signal x.

The amplification may e.g. be applied in the case that the following conditions hold: when the input earpiece audio signal x is active, i.e. the far-end side participant is speaking, and when the local background noise disturbs the intelligibility on the near-end side.

Embodiments of the invention aim at emulating the behavior of a participant as user of a communication device who manually adjusts the magnitude of the earpiece audio signal in case of changing environmental noise. Two successive audio signal processing steps can be applied in order to determine the local environmental noise magnitude using the microphone audio signal y, and to add an offset to a predetermined user gain factor forming an earpiece gain when the determined microphone noise magnitude exceeds a predetermined noise magnitude threshold $\eta_{wy}$. The predetermined user gain factor forming the earpiece gain can be preselected by the participant or user.

Local noise estimation using a built-in microphone 309 may be based on voice activity detection (VAD) because the background noise may only be determined when the participant does not speak. An attempt to determine the background noise magnitude while the participant is speaking may result in an incorrect noise estimate. Such voice activity detection may be error-prone and may not be implemented as a low-complexity time-domain approach in particular for noisy environments. In order to achieve the desired beneficial properties, embodiments of the invention are based on the assumption that when the far-end side participant speaks, the near-end side participant is typically silent, i.e. simultaneous talk is typically rare.

Embodiments of the invention robustly perform voice activity detection on the input earpiece audio signal x in order to detect when the far-end side participant speaks, and obtain a microphone noise magnitude indicator signal $w_y$ from the microphone audio signal y only when the far-end side participant speaks.

Thereby, the following advantages can be realized. By considering the statistics of the input earpiece audio signal x in the first step, it can be assumed that an active earpiece audio signal corresponds very likely to a quiet local participant. Thus, the microphone noise magnitude indicator signal $w_y$ can be determined more reliably. In the second step, a gain of the input earpiece audio signal x may only be increased under the condition that the input earpiece audio signal x is active, i.e. contains useful information and not only noise components. Moreover, the magnitude of the earpiece audio signal may only be adjusted when local background noise disturbs the communication. Furthermore, as obtaining voice activity detection on noisy audio signals may be error-prone, performing voice activity detection on the input earpiece audio signal x can be more robust. In specific scenarios, the microphone audio signal y can be assumed to be noisy.

A volume defined by the participant as user of the communication device for the earpiece audio signal may not be modified. Only an offset may be applied, thereby decoupling the effect of the described approach and the way the user wants to interact with his communication device. Embodiments of the invention directly influence the quality of the local earpiece audio signal as a function of the local background noise magnitude. The audio signal processing may directly benefit the participant and not his correspondent participant on the other side of the conversation.

Figure 3:
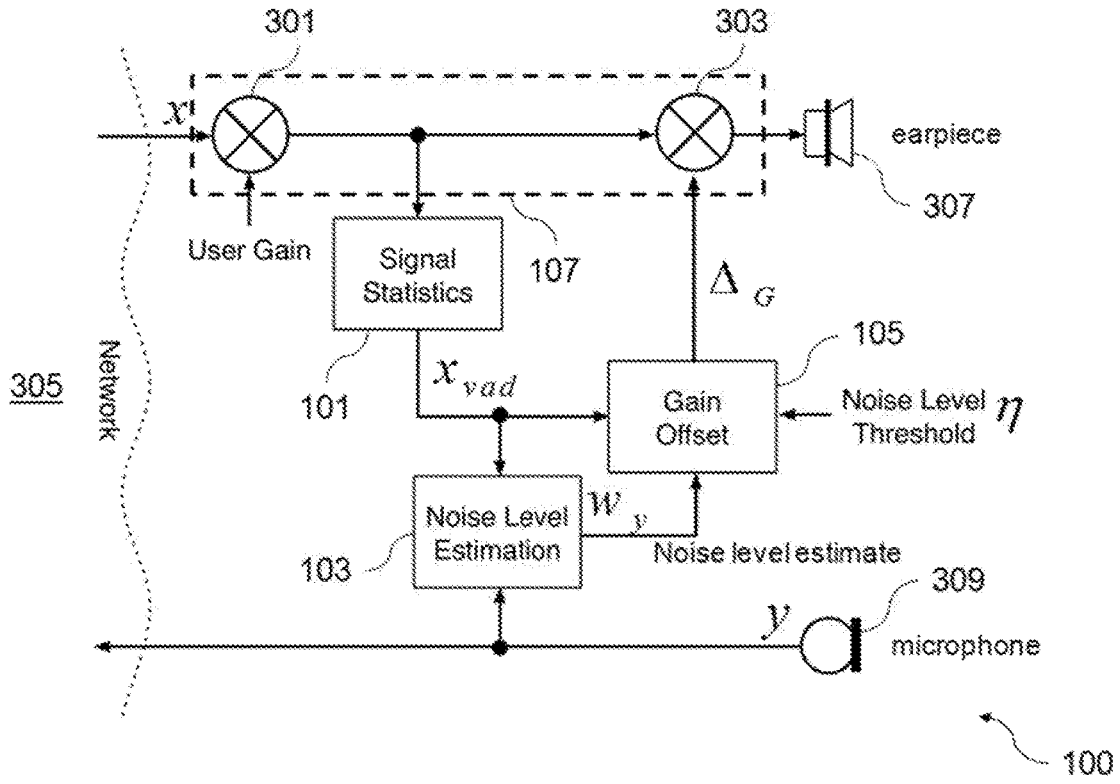
FIG. 3 shows a diagram of an audio signal processing apparatus for processing an input earpiece audio signal upon the basis of a microphone audio signal according to an embodiment.

FIG. 3 shows a diagram of an audio signal processing apparatus 100 for processing an input earpiece audio signal x upon the basis of a microphone audio signal y according to an embodiment. The input earpiece audio signal x is associated with the microphone audio signal y. The diagram illustrates noise estimation of the microphone audio signal y and gain offset adjustment of the earpiece audio signal x.

The audio signal processing apparatus 100 comprises a voice activity detector 101 being configured to determine a voice activity indicator signal $x_{vad}$ upon the basis of the input earpiece audio signal x, wherein the voice activity indicator signal $x_{vad}$ indicates a magnitude of a voice component within the input earpiece audio signal x, a noise magnitude determiner 103 being configured to determine a microphone noise magnitude indicator signal $w_y$ upon the basis of the microphone audio signal y, wherein the microphone noise magnitude indicator signal $w_y$ indicates a magnitude of a noise component within the microphone audio signal y, a gain factor determiner 105 being configured to determine a gain factor signal $\Delta_G$ upon the basis of the voice activity indicator signal $x_{vad}$ and the microphone noise magnitude indicator signal $w_y$, wherein the gain factor signal $\Delta_G$ indicates a gain associated with the input earpiece audio signal x, and a weighter 107 being configured to weight the input earpiece audio signal x by the gain factor signal $\Delta_G$ to obtain an output earpiece audio signal. The noise magnitude determiner 103 is further configured to determine the microphone noise magnitude indicator signal $w_y$ upon the basis of the voice activity indicator signal $x_{vad}$. The voice activity detector 101 can determine signal statistics of the input earpiece audio signal x. The noise magnitude determiner 103 can perform a noise level estimation or noise magnitude estimation of the microphone audio signal y. The gain factor determiner 105 can determine a gain offset.

The gain factor determiner 105 is further configured to compare the microphone noise magnitude indicator signal $w_y$ with a predetermined noise magnitude threshold $\eta_{wy}$. The gain factor determiner 105 is further configured to determine the gain factor signal $\Delta_G$ if the microphone noise magnitude indicator signal $w_y$ is greater than the predetermined noise magnitude threshold $\eta_{wy}$.

The weighter 107 comprises a first multiplier 301 and a second multiplier 303. The first multiplier 301 is configured to multiply the input earpiece audio signal x by a predetermined user gain factor, and the second multiplier 303 is configured to weight the result by the gain factor signal $\Delta_G$. The audio signal processing apparatus 100 can further comprise a communication interface being configured to receive the input earpiece audio signal x over a communication network 305, and to transmit the microphone audio signal y over the communication network 305. The audio signal processing apparatus 100 further comprises an earpiece 307 being configured to emit the output earpiece audio signal, and a microphone 309 being configured to provide the microphone audio signal y.

The microphone noise magnitude indicator signal $w_y$ indicating local background noise components is determined from the microphone audio signal y, whereas the computation of the gain factor signal $\Delta_G$ forming an earpiece gain offset is performed based on the microphone noise magnitude indicator signal $w_y$. The statistics to achieve voice activity detection are determined based on the input earpiece audio signal x, and not on the noisy microphone audio signal y. This results in a more robust noise estimate, in particular in noisy environments, since the noise magnitude is only estimated when the far-end side participant is talking and the magnitude of the input earpiece audio signal x may only be increased when the far-end side participant is talking and the near-end side noise magnitude is high.

The noise magnitude estimation can be performed as follows. The noise magnitude estimation may capture stationary noise signals and may be able to react to changing noise conditions. Let y be the time-domain microphone audio signal, then the corresponding noise magnitude estimation can be carried out using two mechanisms, including minimum statistics, and two-side temporal smoothing.

Firstly, the minimum statistics scheme is performed as follows:

$$y_{min}(n)=\min_{0\le p\le P} y(n-p). \tag{1}$$

The minimum statistics scheme yields a minimum of the microphone audio signal y over a time window having a duration P according to:

$$P=\tau_P f_s, \tag{2}$$

wherein $f_s$ denotes a sampling rate and $\tau_P$ the physical time e.g. expressed in seconds. The physical time $\tau_P$ may e.g. be chosen between 1 s and 2 s. Secondly, the noise estimate can be derived using a two side temporal smoothing:

$$\hat{w}(n)=\begin{cases}\alpha_{att} y_{min}(n)+(1-\alpha_{att})\hat{w}(n), & \text{if } y_{min}(n)>\hat{w}(n)\\ \alpha_{rel} y_{min}(n)+(1-\alpha_{rel})\hat{w}(n), & \text{otherwise}\end{cases} \tag{3}$$

wherein $\alpha_{att}$ and $\alpha_{rel}$ are two smoothing time constants for attack and release, respectively. They can be derived according to:

$$\alpha_{att,rel}=\tau_{att,rel} f_s, \tag{4}$$

wherein $\tau_{aft}$ and $\tau_{rel}$ are physical values e.g. chosen to be around 100 ms and around 10 s, respectively.

Simultaneously, on the earpiece audio signal, voice activity detection can be carried out by the voice activity detector 101 which can derive statistics from the earpiece audio signal in order to characterize the conversation and discriminate which side is active. The voice activity detection on the earpiece audio signal can be used to guide the noise magnitude estimate of the microphone audio signal y according to:

$$\hat{v}(n)=\begin{cases}\alpha_{att} x_{min}(n)+(1-\alpha_{att})\hat{v}(n), & \text{if } x_{min}(n)>\hat{v}(n)\\ \alpha_{rel} x_{min}(n)+(1-\alpha_{rel})\hat{v}(n), & \text{otherwise}\end{cases}$$

wherein $x_{min}$ denotes a minimum statistics estimate of x according to equation (1). For example, a simple voice activity detector 101 can be implemented. Analogously as for the microphone audio signal y described in equation (3), a noise estimate $w_x$ for the input earpiece audio signal x can be derived.

Additionally, two more statistics can be derived e.g. corresponding to a slow and a fast envelope of x, respectively. A first envelope indicator signal $x_s$ indicating a slow envelope can be determined as:

$$x_s(n)=\begin{cases}\alpha_{satt} x(n)+(1-\alpha_{satt})x_s(n), & \text{if } x(n)>x_s(n)\\ \alpha_{srel} x(n)+(1-\alpha_{srel})x_s(n), & \text{otherwise}\end{cases} \tag{5}$$

A second envelope indicator signal $x_f$ indicating a fast envelope can be determined as:

$$x_f(n)=\begin{cases}\alpha_{fatt} x(n)+(1-\alpha_{fatt})x_f(n), & \text{if } x(n)>x_f(n)\\ \alpha_{frel} x(n)+(1-\alpha_{frel})x_f(n), & \text{otherwise}\end{cases} \tag{6}$$

The smoothing time constants $\alpha_{satt}$, $\alpha_{srel}$, $\alpha_{fatt}$ and $\alpha_{frel}$ can be derived as in equation (4) given the physical time values $\tau_{satt}$, $\tau_{srel}$, $\tau_{fatt}$ and $\tau_{frel}$. The voice activity detection can then be performed by comparing the earpiece noise magnitude indicator signal $\hat{v}$ to the envelope indicator signals $x_s$ and $x_f$ according to:

$$x_{vad}(n)=\frac{x_f(n)}{\max\{x_s(n),\ \beta\hat{v}(n)\}}, \tag{7}$$

wherein β is an over-estimation factor applied to the noise magnitude estimate. The voice activity indicator signal $x_{vad}$ can further be limited to a predetermined voice activity indicator limiting range, e.g. the range [0; 1], and smoothed in order to avoid quickly fluctuating values.

The noise magnitude estimate may not be able to discriminate between background noise and voice components from the near-end side participant. The voice component may therefore corrupt the noise magnitude estimate. The combination of voice activity detection and noise magnitude estimation can allow for improving the robustness of the noise magnitude estimates. This step can be optional; it is also possible to set:

$$w_y(n)=\hat{w}(n)$$

Advantageously, the microphone noise magnitude indicator signal $w_y$ of the microphone audio signal y is determined under the assumption that an active input earpiece audio signal x corresponds to a quiet local participant, i.e. double-talk is unlikely. For this purpose, statistics of the earpiece audio signal can be considered in order to make a decision whether the microphone audio signal y exclusively comprises noise components or not, leading to a more reliable local environmental microphone noise magnitude indicator signal $w_y$:

$$w_y(n)=\alpha_{vad}\hat{w}(n)+(1-\alpha_{vad})w_y(n-1), \tag{8}$$

wherein an update rate $\alpha_{vad}$ can be indexed with regard to a previously derived earpiece audio signal statistic according to equation (7). For example, simply apply:

$$\alpha_{vad}=x_{vad}(n), \tag{9}$$

or any other function of $x_{vad}$. As a result, tracking of local environmental noise magnitudes can be performed faster and more robustly. Eventually, it can even be combined with statistics with regard to the microphone audio signal y for further improved robustness.

The determination of the gain factor signal $\Delta_G$ forming an earpiece gain offset can be performed based on the noise magnitude estimate. It can stay 0 dB when no background noise components are detected locally or the input earpiece audio signal x is inactive. It can increase whenever the detected background noise magnitude locally reaches a predetermined noise magnitude threshold $\eta_{wy}$ forming a threshold of annoyance and the input earpiece audio signal x is active.

When the microphone noise magnitude indicator signal $w_y$ indicating the local environmental noise magnitude exceeds the predetermined noise magnitude threshold $\eta_{wy}$, i.e. the threshold of annoyance, the gain of the earpiece audio signal is increased by an offset according to:

$$\Delta_G(n) = x_{vad}(n)\frac{w_y(n)}{\eta_{w_y}}. \tag{10}$$

In order to avoid highly and quickly fluctuating values, the resulting gain factor signal $\Delta_G$ can be limited with regard to a predetermined gain factor limiting range, e.g. to a maximal value within the interval [1; $\Delta_{G0}$], and can be smoothed over time.

Again, by considering statistics of the input earpiece audio signal x, the gain can be controlled such that the gain offset is only applied when the input earpiece audio signal x is active in order to avoid boosting noise-only input earpiece audio signals. Because of the additive nature of the gain offset, the participant as user of the communication device can have full control over the resulting volume or magnitude of the earpiece audio signal at any time.

Embodiments of the invention realize different advantages. The audio signal processing apparatus 100 and the audio signal processing method 200 provide a means to directly enhance an earpiece audio signal giving benefits to the local participant of a communication device and not its correspondent participant on the other side of the conversation. The earpiece audio signal may be modified only when it is active and the noise magnitude estimation may only be performed when the earpiece audio signal is not active.

A gain offset may be applied independently of how the participant sets the volume of a communication device. The microphone 309 can directly be used to provide a microphone audio signal y for noise magnitude estimation, wherein no additional hardware may be used. A user gain factor, which can be predetermined by the user for the earpiece 307, may not be modified. Only an offset may be applied, thereby decoupling the effect of the described approach and how the user wants to interact with his communication device.

Moreover, an increased robustness can be provided because the voice activity detection can be based on a clean earpiece audio signal and not on a noisy microphone audio signal y. Furthermore, a reduced complexity can be achieved because a simple time domain voice activity detector 101 can be used as a result of the increased robustness.

The described approach can mimic the behavior of a user changing the volume or magnitude of the earpiece audio signal when the noise magnitude increases above a predetermined noise magnitude threshold $\eta_{wy}$ forming an annoyance threshold. The gain offset may only be applied in case that the far-end side participant is talking and the near-end side noise magnitude is above the predetermined noise magnitude threshold $\eta_{wy}$. Thus, any boosting of noise-only input earpiece audio signals may be efficiently avoided.

Embodiments of the invention relate to a communication device, e.g. a phone, wherein a local environmental noise magnitude is determined using a microphone 309. A user-selected volume of the earpiece audio signal can be increased by an offset when the determined local environmental noise magnitude exceeds a predetermined noise magnitude threshold $\eta_{wy}$. Considering statistics of the input earpiece audio signal x, voice activity detection can be used to trigger the microphone noise magnitude estimation when an active input earpiece audio signal x indicates a quiet local participant, thus leading to an increased robustness. Voice activity detection on the input earpiece audio signal x can be used to apply the gain offset only when the input earpiece audio signal x is active.

Embodiments of the invention may be implemented in a computer program for running on a computer system, at least including code portions for performing steps of a method according to the invention when run on a programmable apparatus, such as a computer system or enabling a programmable apparatus to perform functions of a device or system according to the invention.

A computer program is a list of instructions such as a particular application program and/or an operating system. The computer program may for instance include one or more of: a subroutine, a function, a procedure, an object method, an object implementation, an executable application, an applet, a servlet, a source code, an object code, a shared library/dynamic load library and/or other sequence of instructions designed for execution on a computer system.

The computer program may be stored internally on computer readable storage medium or transmitted to the computer system via a computer readable transmission medium. All or some of the computer program may be provided on transitory or non-transitory computer readable media permanently, removably or remotely coupled to an information processing system. The computer readable media may include, for example and without limitation, any number of the following: magnetic storage media including disk and tape storage media; optical storage media such as compact disk media (e.g., CD-ROM, CD-R, etc.) and digital video disk storage media; nonvolatile memory storage media including semiconductor-based memory units such as FLASH memory, EEPROM, EPROM, ROM; ferromagnetic digital memories; MRAM; volatile storage media including registers, buffers or caches, main memory, RAM, etc.; and data transmission media including computer networks, point-to-point telecommunication equipment, and carrier wave transmission media, just to name a few.

A computer process typically includes an executing or running program or portion of a program, current program values and state information, and the resources used by the operating system to manage the execution of the process. An operating system (OS) is the software that manages the sharing of the resources of a computer and provides programmers with an interface used to access those resources. An operating system processes system data and user input, and responds by allocating and managing tasks and internal system resources as a service to users and programs of the system.

The computer system may for instance include at least one processing unit, associated memory and a number of input/output (I/O) devices. When executing the computer program, the computer system processes information according to the computer program and produces resultant output information via I/O devices.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality.

Thus, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or inter-medial components. Likewise, any two components so associated can also be viewed as being "operably connected" or "operably coupled" to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in nonprogrammable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as computer systems.

However, other modifications, variations and alternatives are also possible. The specifications and drawings are, accordingly, to be regarded in an illustrative rather than in a restrictive sense.

What is claimed is:

1. An audio signal processing apparatus for processing an input earpiece audio signal upon the basis of a microphone audio signal, the input earpiece audio signal being associated with the microphone audio signal, the audio signal processing apparatus comprising:

a voice activity detector being configured to determine a voice activity indicator signal upon the basis of the input earpiece audio signal, wherein the voice activity indicator signal indicates a magnitude of a voice component within the input earpiece audio signal;

a noise magnitude determiner being configured to determine a microphone noise magnitude indicator signal upon the basis of the microphone audio signal, wherein the microphone noise magnitude indicator signal indicates a magnitude of a noise component within the microphone audio signal;

a gain factor determiner being configured to determine a gain factor signal upon the basis of the voice activity indicator signal and the microphone noise magnitude indicator signal, wherein the gain factor signal indicates a gain associated with the input earpiece audio signal; and a weighter being configured to weight the input earpiece audio signal by the gain factor signal to obtain an output earpiece audio signal.

2. The audio signal processing apparatus of claim 1, wherein the voice activity detector is further configured to determine an earpiece noise magnitude indicator signal upon the basis of the input earpiece audio signal, wherein the earpiece noise magnitude indicator signal indicates a magnitude of a noise component within the input earpiece audio signal.

3. The audio signal processing apparatus of claim 2, wherein the voice activity detector is further configured to determine a first envelope indicator signal and a second envelope indicator signal, wherein the first envelope indicator signal indicates a magnitude of a first envelope of the input earpiece audio signal, wherein the second envelope indicator signal indicates a magnitude of a second envelope of the input earpiece audio signal, and wherein the voice activity detector is further configured to determine the voice activity indicator signal based on the earpiece noise magnitude indicator signal, the first envelope indicator signal, and the second envelope indicator signal.

4. The audio signal processing apparatus of claim 1, wherein the voice activity detector is further configured to limit the voice activity indicator signal with regard to a predetermined voice activity indicator limiting range.

5. The audio signal processing apparatus of claim 1, wherein the voice activity detector is further configured to filter the voice activity indicator signal in time upon the basis of a predetermined smoothing filtering function.

6. The audio signal processing apparatus of claim 1, wherein the noise magnitude determiner is further configured to determine the microphone noise magnitude indicator signal upon the basis of the voice activity indicator signal.

7. The audio signal processing apparatus of claim 1, wherein the gain factor determiner is further configured to compare the microphone noise magnitude indicator signal with a predetermined noise magnitude threshold, and wherein the gain factor determiner is further configured to determine the gain factor signal if the microphone noise magnitude indicator signal is greater than the predetermined noise magnitude threshold.

8. The audio signal processing apparatus of claim 1, wherein the gain factor determiner is further configured to compare the voice activity indicator signal with a predetermined voice activity threshold, and wherein the gain factor determiner is further configured to determine the gain factor signal if the voice activity indicator signal is greater than the predetermined voice activity threshold.

9. The audio signal processing apparatus of claim 1, wherein the gain factor determiner is further configured to determine the gain factor signal according to the following equation:

$$\Delta_G(n) = x_{vad}(n)\frac{w_y(n)}{\eta_{w_y}},$$

wherein $\Delta_G$ denotes the gain factor signal, $w_y$ denotes the microphone noise magnitude indicator signal, $\eta_{wy}$ denotes a predetermined noise magnitude threshold, $x_{vad}$ denotes the voice activity indicator signal, and n denotes a sample index.

10. The audio signal processing apparatus of claim 1, wherein the gain factor determiner is further configured to limit the gain factor signal with regard to a predetermined gain factor limiting range.

11. The audio signal processing apparatus of claim 1, wherein the gain factor determiner is further configured to filter the gain factor signal in time upon the basis of a further predetermined smoothing filtering function.

12. The audio signal processing apparatus of claim 1, wherein the weighter is further configured to weight the input earpiece audio signal by a predetermined user gain factor.

13. The audio signal processing apparatus of claim 1, further comprising:

a communication interface being configured to receive the input earpiece audio signal over a communication network, and to transmit the microphone audio signal over the communication network.

14. An audio signal processing method for processing an input earpiece audio signal upon the basis of a microphone audio signal, the input earpiece audio signal being associated with the microphone audio signal, the audio signal processing method comprising:

determining a voice activity indicator signal upon the basis of the input earpiece audio signal, wherein the voice activity indicator signal indicates a magnitude of a voice component within the input earpiece audio signal;

determining a microphone noise magnitude indicator signal upon the basis of the microphone audio signal, wherein the microphone noise magnitude indicator signal indicates a magnitude of a noise component within the microphone audio signal;

determining a gain factor signal upon the basis of the voice activity indicator signal and the microphone noise magnitude indicator signal, wherein the gain factor signal indicates a gain associated with the input earpiece audio signal; and weighting the input earpiece audio signal by the gain factor signal to obtain an output earpiece audio signal.

15. A non-transitory computer readable storage medium storing instructions, which when executed by a computer, causes the computer to be configured to:

determine a voice activity indicator signal upon the basis of the input earpiece audio signal, wherein the voice activity indicator signal indicates a magnitude of a voice component within the input earpiece audio signal;

determine a microphone noise magnitude indicator signal upon the basis of the microphone audio signal, wherein the microphone noise magnitude indicator signal indicates a magnitude of a noise component within the microphone audio signal;

determine a gain factor signal upon the basis of the voice activity indicator signal and the microphone noise magnitude indicator signal, wherein the gain factor signal indicates a gain associated with the input earpiece audio signal; and weight the input earpiece audio signal by the gain factor signal to obtain an output earpiece audio signal.

* * * * *